US005826910A

United States Patent [19]

Ricks et al.

[11] Patent Number: 5,826,910

[45] Date of Patent: Oct. 27, 1998

[54] SWIVELABLE SNOWBOARD BINDINGS

[76] Inventors: Richard A. Ricks, P.O. Box 1066, Pittsburg, Calif. 94565; Paul R. Scherer, 1955 Webster St., San Francisco, Calif. 94115

[21] Appl. No.: 763,554

[22] Filed: Dec. 9, 1996

[51] Int. Cl.[6] ..... A63C 9/08

[52] U.S. Cl. ..... 280/618; 280/14.2

[58] Field of Search ..... 280/14.2, 607, 280/620, 14.36, 623, 618, 611

[56] References Cited

U.S. PATENT DOCUMENTS 5,553,883 9/1996 Erb ..... 280/14.2
5,667,237 9/1997 Lager ..... 280/14.2

*Primary Examiner*—Richard M. Camby

[57] ABSTRACT

Swivelable bindings assembly for a snowboard, for selective rotational adjustment of the bindings about an axis normal to the upper surface of the snowboard, the assembly including a rotatably adjustable bindings plate having a bottom surface, an upper portion adapted for releasably supporting a user's boot, and a relatively large diameter circular opening in the central portion of the plate. The assembly includes a holds-down disk that is received in the plate opening and is adapted to slidably engage edge portions of the plate opening to restrain the plate against upward separation from the disk and to hold the plate with its bottom surface slidably engaged with, and vertically supported by, the low-friction planar surface of a sheet of material secured to the top of the snowboard, the disk also serving to mount the plate for rotation about an axis through the center of the disk. Mechanism for releasably locking the plate at selected rotational positions includes a locking pin with an elongate shaft that engages a horizontal bore extending from an edge of the base plate to the base plate opening, the plate being rotatable to bring the bore in alignment with at least one recess in the outer edge of the disk whereby the pin shaft can be engaged in a selected recess to secure the plate against rotation.

19 Claims, 3 Drawing Sheets

SWIVELABLE SNOWBOARD BINDINGS

BACKGROUND OF THE INVENTION

1. Field of the Invention

The present invention relates to bindings for snowboards and the like, and more particularly to such bindings that can be adjusted with respect to its angular orientation to the longitudinal centerline of the snowboard.

2. Description of the Prior Art

The recent surge in popularity of the sport of snowboarding has brought renewed interest in addressing certain problems that are unique to the sport, as opposed to other skiing endeavors such as alpine skiing and water skiing. First, it is noted that according to the conventional arrangement of bindings on a snowboard, fore and aft binding assemblies are secured to the board in a manner to support both feet at a substantial angle with respect to the longitudinal centerline of the board. This cross orientation of the bindings allows the user to assume a side-forward position necessary for optimum control of the board during active snowboarding. It is also noted that snowboarders often desire to modify the angle of the feet relative to the centerline of the board to achieve maximum performance during their run. Such changes in the angle of the feet can be necessitated by the degree of incline of the slope, the amount and quality of the snow encountered, or the amount of 'jumping' desired during descent. When a down-hill run is completed it is necessary for the user to use self-propulsion methods to maneuver over flat terrain and to negotiate the life line and to get in position for pick up by a lift chair. In order to do this the snowboarder will commonly release the aft foot from its bindings so that he or she can use a "skateboarding" technique in which the free foot is used for propulsion. Unfortunately, because of the transverse orientation of the secured foot and the face-forward position that the maneuvering snowboarder tries to assume, the leg is forced towards an unnatural position causing stress and strain on the entire leg, including the vulnerable ankle and knee joints. Of course the snoboarder has the option of detaching both feet from the board and hand carrying the board in such circumstances, but such procedure is inconvenient and time consuming. Furthermore, the cross-orientation of the bindings can lead to difficulties when riding the lift chair, requiring the board to be held in an unwieldy manner that can interfere with a companion lift chair rider, and also causing stress and strain in the secured leg of the user.

It has become evident that one way to address these problems would be in providing bindings that are adjustable with respect to their angular orientations to the board centerline. U.S. Pat. Nos. 5,261,689 and 5,356,170 to Carpenter et al. show snowboard boot binding systems of a popular type that employs a hold-down disk that engages a circular opening in a boot mounting plate whose bottom is supported on a snowboard. A number of vertical bores through the hold-down disk allow it to be secured to threaded bores in the board using threaded bolts or screws, and ordinarily there are extra pairs of threaded bores in the board to allow adjustment between the fore and aft bindings in several different longitudinal positions, to accommodate the desired feet-apart stance of the rider. There are ridges or splines on the hold-down disk that engage complementary ridges or splines on the binding plate, to secure the plate at a given angular orientation. This will allow angular adjustment of the bindings, but unfortunately, to accomplish this, several bolts per hold-down disk, usually four, must be loosened using a suitable tool in order to loosen the disk sufficiently form the plate to allow rotation of the plate to a new orientation. The fasteners must then be retightened. The bindings system of U.S. Pat. No. 5,004,654 is somewhat of an improvement in this respect since it requires tightening and loosening on only a single bolt.

Unfortunately, while the systems shown in above-mentioned patents allow angular adjustment, they share the major drawback in not allowing such adjustment to be made quickly, easily and conveniently, because they require removal of the boot from the bindings in each case, and the use of tools to loosen and tighten the fasteners.

U.S. Pat. No. 5,354,088 show a snowboard binding that can be rapidly and easily removed from the board, should this be a solution to the above-discussed problems, but this disclosure does not show a means for rapidly adjusting the angle of the bindings.

Relatively recent approaches to the need for rotatably adjustable bindings are revealed in U.S. Pat. No. 5,277,635 to Gillis, and U.S. Pat. No. 5,499,837 to Hale. The system shown in Gillis is suited for use on water ski boards, however it appears that the locking mechanism would not be adequate for use in a snowboard environment. The system of the Hale patent appears to be an improvement, however it's locking mechanism that depends on specially formed vertically opposed undulating surfaces that can be brought in and out of engagement, appears unduly complex and expensive.

SUMMARY OF THE INVENTION

In view of the foregoing it is a general object of the present invention to provide a snowboard user with the capability of quickly and easily adjusting the rotational position of the boot bindings, and further, to provide such capability without requiring removal of the boots from the bindings.

A more particular object is to provide a snowboard boot binding system that allows the bindings to be rapidly adjusted and locked in one of several different angular positions as desired for operational use of the board, and being also rapidly adjustable to a toe-forward position for use in "skate-boarding" and riding the chair lift.

Another object is to provide such an adjustable boot binding assembly that is relatively simple yet highly effective for its intended purpose.

Yet another object is to provide such a rotatably adjustable binding assembly that can be economically fabricated.

These and other objects and advantages are provided by the present invention of a swivelable binding assembly for a snowboard, for selective rotational adjustment of the bindings about an axis normal to the upper surface of the snowboard, the assembly including a rotatable bindings plate having a main body with opposing sides, a bottom, an outer edge, and an upper portion adapted for releasably supporting a user's boot, and a central opening. The assembly also includes a hold-down disk engagable in the plate opening and adapted to be stationarily affixed to the snowboard and having outer edge means for slidably engaging edge portions of the plate opening to restrain the plate against upward movement and also to mount the plate for rotation about an axis normal to the center of the disk.

The invention also features releasable locking means for selectively stationarily securing the plate at different rotated positions relative to the hold-down disk, the locking means including a locking element, having an inner end and an outer end, and mounted in the plate body for movement towards and away from the central opening, and at least one radially extending recess in the outer edge of the hold-down disk, whereby the plate is rotatable to bring the inner end of the locking element into alignment with the at least one recess, the locking element inner end then being engagable in the aligned recess to effectively hold the plate against rotation relative to the disk.

In a preferred embodiment of the invention there is included a flat support sheet with a top layer of a low friction material, the sheet being secured over the top surface of the board with its low-friction and non-stick surface in slidable engagement with, and in vertical support of, the bottom of the bindings plate.

In on preferred embodiment of the invention the locking element is an elongate locking pin slidably received for longitudinal movement in a bore that extends from the plate outer edge to the central opening, and there is means for resiliently urging the pin inwardly of the bore towards engagement with the disk, and there is a plurality of said radically extending recesses spaced apart at selected intervals along the disk outer edge portion. In these cases the outer end of the locking pin is provided with a handle portion large enough to be grasped by a gloved hand for pulling the pin outwardly from engagement with the disk so as to quickly and easily unlock the plate for free rotation to a desired orientation. Preferably the bore for the pin extends radially (with respect to the central opening), and from a forward corner of the bindings plate on the instep side of the plate.

In some cases the means for resiliently holding the locking element comprises a tensioned elastic member interconnecting the outer externally located end of the pin with the bindings plate, and in other embodiments the pin is controlled by a coil spring mounted within the plate. In yet another embodiment the locking pin has plural projections that can engage splines arrayed on the periphery of the hold-down-disk.

DETAILED DESCRIPTION OF THE INVENTION

Figure 1:
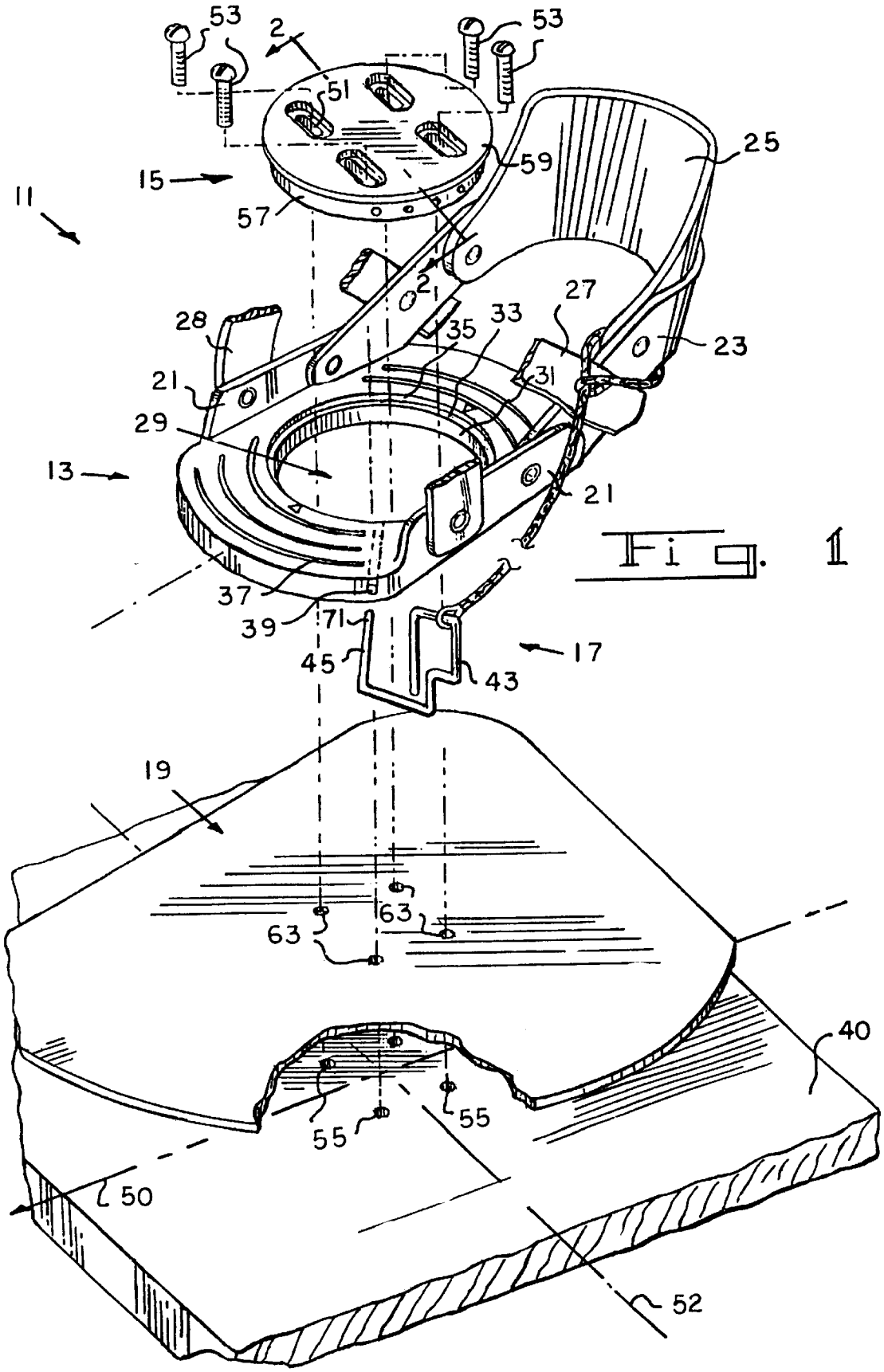
FIG. 1 is an exploded perspective view, with certain parts broken away for the sake of clarity, of a swivelable snowboard boot binding assembly according to the present invention.

Referring now to the drawings, FIG. 1 shows a preferred embodiment of a swivelable boot binding assembly 11 according to the present invention in which the main components comprise a rotatable boot bindings plate 13, a hold-down disk 15, a locking mechanism 17, and a plate support sheet 19.

The bindings plate 13 and the hold-down disk 15 are formed of a suitable high strength, high impact plastic material such as a polycarbonate material, using molding techniques known in the plastics-forming industry. Hold-down disk 15 can also be made of a suitable metal such as aluminum or a steel alloy using well-know metal-working techniques. Plate 13 has opposing side walls 21 with rear portions to which is secured a heel support 23 which mounts a highback 25 and ankle straps 27. Toe straps 29 are attachable to holes in the forward portion of the sidewalls 21.

As FIG. 1 also shows, the bindings plate 13 has a central circular opening 29 that has an inner edge portion with a smooth bore 31, a sunken annular surface 33, and an upper bore 35. As a part of the locking mechanism, to be described below, there is a horizontal relatively narrow bore 37 that extends radially, i.e. towards the center of the opening 29, from a forward corner 39 of plate 13 to the bore 31 of opening 29.

Figure 3:
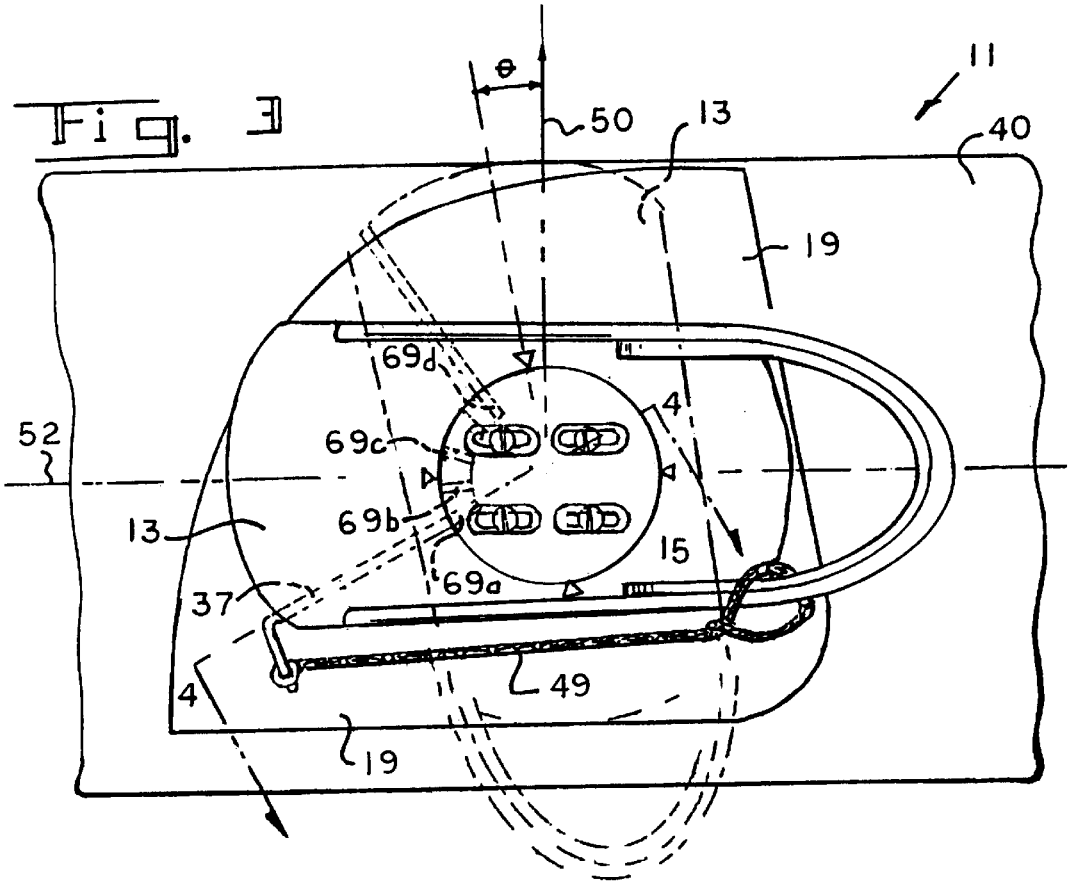
FIG. 3 is a top plan view illustrating in solid lines the toe-forward position of the bindings of FIG. 1, and in broken lines, showing the bindings in a rotated operational position.
Figure 2:
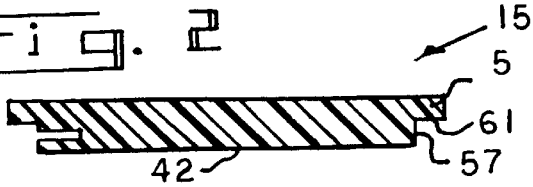
FIG. 2 is an enlarged sectional view of the hold-down disk taken along the line 2—2 of FIG. 1.

The hold-down disk 15 is used to mount the plate 13 to a snowboard 40 in a manner that firmly retains the plate to the board while allowing for rotational adjustment of the plate 13 relative to the snowboard transverse centerline 50 (that is at right angles to the longitudinal centerline 52 of the snowboard). As FIG. 1 shows, the hold-down disk 15 has holes 51 for receiving bolts 53 for engaging threaded bores 55 in the snowboard 40 for stationarily securing hold-down disk 15 to the snowboard, the holes 51 being oblong to allow a certain amount of fine adjustment of the disk placement in the longitudinal direction of the snowboard. Hold-down disk 15 is designed to engage the opening 29, and as shown in FIGS. 1 and 2 it has a smooth cylindrical portion 57 and a flange or lip portion 59. As FIG. 4 best illustrates, when hold-down disk 15 is secured to snowboard 40 with the disk bottom 42 engaged against the support sheet 19, the disk lip portion 59 provides a smooth annular surface 61 that is disposed in slidable contact with the plate annular surface 33 to retain the plate against vertical separation from the board. Also note that the hold-down disk cylindrical portion 57 is slidably received in the plate bore 31 so as to mount the plate for rotation about a vertical axis through the disk center. Rotational mounting of the plate 13 is also provided by virtue of the slidable engagement of the outer edge of the disk lip portion 59 in the upper bore 35 of plate 13. It is further noted in FIG. 4 that the plate bottom 44 is disposed in slidable engagement with the top surface of the support sheet 19, so as to provide vertical support to the plate bottom. The configuration of sheet 19, shown in FIG. 3, is such that sheet 19 remains in contact with the bottom of plate 13 in all of the positions to which the plate can be rotated, as will be described. Sheet 19 is a flat sheet of ⅛ inch thick aluminum covered with a coating of a suitable durable low-friction material such as Teflon. The holes 63 receive the bolts 53 so that the sheet 19 can be secured to the snowboard 40 when the hold-down disk 15 is attached to the snowboard. Alternatively, a support sheet can be adhesively bonded to the upper surface of snowboard 40 using a suitable adhesive.

As FIG. 1 illustrates, the locking mechanism 17 includes a locking pin having a handle portion 43 and a shaft 45 that is snugly and slidably received in bore 37. The locking pin is preferably fabricated of a suitably strong and durable metal such as stainless steel or brass. Also note there is a tensioned elastic cord 49, of a conventional commercially available type, that has one end attached about the heel support 23, as shown, and an opposite end secured to the locking pin handle portion 43, the cord 49 serving to urge the pin shaft 45 towards a fully inserted position within bore 39 to operate the locking mechanism in a manner to be described.

Figure 4:
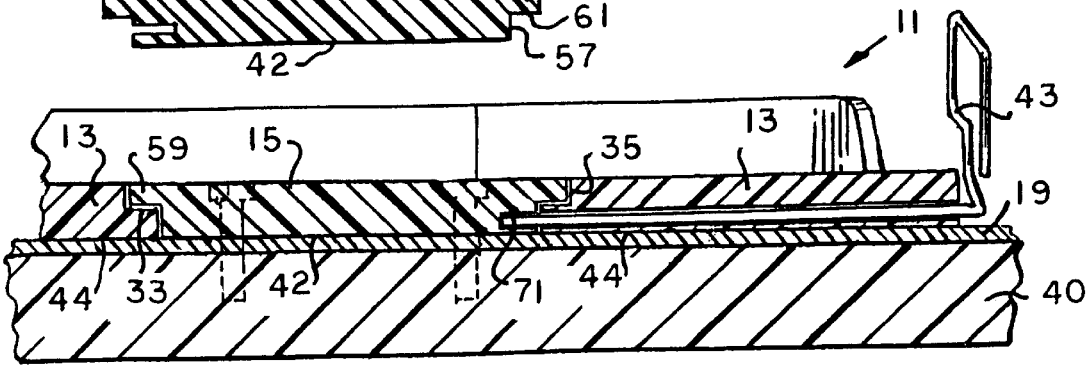
FIG. 4 is an enlarged sectional view taken along the line 4—4 of FIG. 3.

Finally, as FIGS. 1 and 3 show, in this particular embodiment there are several radially extending recesses 69*a*, 69*b*, 69*c*, and 69*d* drilled or otherwise formed in the edge portion 57 of the hold-down disk 15, and these recesses can be brought into alignment, in turn, with the locking pin bore 37 by rotation of plate 13 to accomplish the same. Each of the recesses is adapted to snugly receive a forward end portion 71 of the locking pin, and when a recess is moved into alignment with end portion 71, spring force will urge end 71 into the recess thereby releasably holding the plate stationarily with respect to the hold-down disk. FIG. 4 shows such a locked condition.

First note that the invention provides a first recess 69*a* that is engageable by the locking tip 71 when the bindings are in a toe-forward position as shown in FIG. 3, which orientation can also be described as a 90 degree setting. Thus the snowboard forward boot bindings can be releasably secured in this position for "skateboarding". As mentioned above, it is a common practice for snowboarders to set their bindings at particular orientations across the board, and these settings can vary from about 80 degrees to about minus 15 degrees as measured from a transverse centerline 50, and often the forward and rear bindings are set at different angles. Thus the present invention provides the additional recesses 69*b*, 69*c*, and 69*d* that are spaced apart by increments of about 10 degrees of rotation. FIG. 3 also illustrates how the bindings plate 13 can be secured at a relatively small angular setting θ when the locking pin engages recess 69*d*. The other recesses 69*b* and 69*c* allow for intermediate angular settings, as desired. Note the invention contemplates embodiments wherein there are additional recesses and where the spacing between recesses vary. For example in some designs there can be nine or ten settings and the angular spacing can be 10 degrees, and in other cases 5 degrees.

In operation of the above-described assembly 11, the user need only, in preparation for snowboarding, quickly and easily set the plate 13 at a chosen orientation by withdrawing the locking pin enough to disengage a recess, then rotating the plate to a selected orientation and then releasing the pin to engage the appropriate recess. Of course this can be done without removing boots from the bindings.

Figure 5:
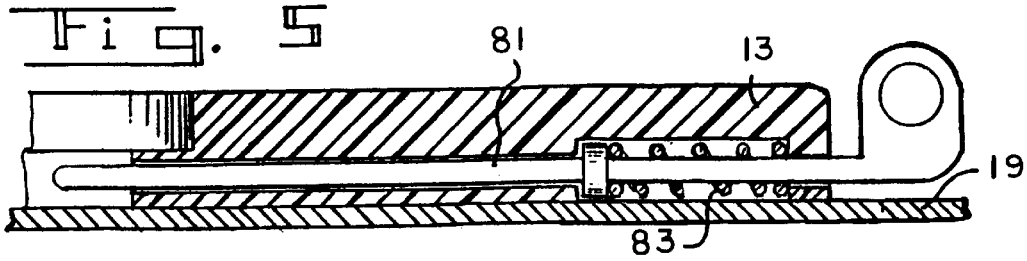
FIG. 5 is an enlarged sectional view showing the locking mechanism of a variant of the invention.

It should be understood that the invention contemplates other configurations of locking pin mechanisms. For example FIG. 5 shows a variant of the invention in which a locking pin 81 is controlled by a coil spring 83 mounted internally of plate 13.

Figure 6:
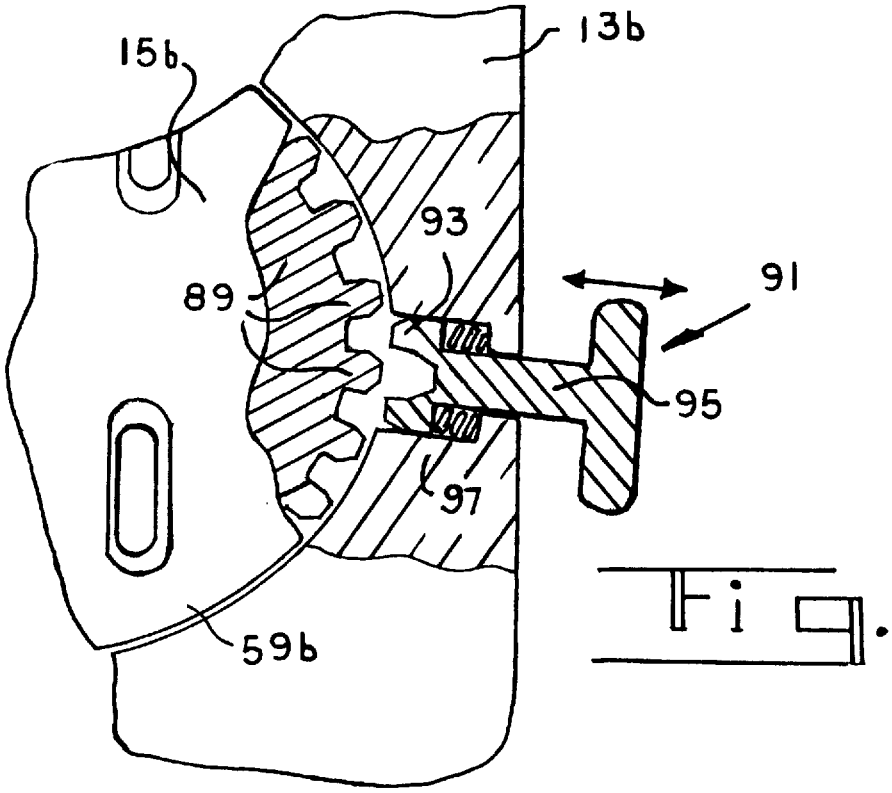
FIG. 6 is an enlarged sectional view illustrating the locking mechanism of yet another variant of the invention.

Yet another variation is shown in FIG. 6 wherein the hold-down disk 15*b* includes a peripherally extending array of splines 89. Note that disk 15*b* is structured similarly to the above-described disk 15 except that here the lip portion 59*b* serves as the rotational hub for the plate 13*b*. A locking mechanism 91, mounted within the plate 13*b* includes a spring-operated latch 95 of rectangular cross-section that is mounted for slidable reciprocal in-and-outward movement, and it features a locking head 97 of plural splines or teeth 93 that are designed to make holding engagement with splines 89. FIG. 6 shows the unlatched position of latch 95.

In summary, while particular embodiments of the invention have been described, it is not intended that the invention be limited thereto. It should be understood that various other modifications and variations may readily occur to those of ordinary skill in the art, given the benefit of this disclosure, without departing from the true scope and breath of the invention as defined in the claims which follow.

What is claimed is:

1. Bindings assembly for a snowboard, the snowboard having an upper surface and a longitudinal axis, for elective rotational adjustment of said bindings with respect to said longitudinal axis, said bindings assembly including:

a. rotatable bindings having a bottom, a perimeter edge, a front, and rear and an upper portion adapted for releasably supporting a boot, and having a central circular opening with an inner edge portion;

b. a hold-down disk adapted for being stationarily affixed to said snowboard, and having edge means for slidably engaging said plate opening edge portion to hold said plate against upward movement form said disk and to mount the plate for rotation about an axis normal to said snowboard, and a plurality of spaced-apart recesses along said disk edge means; and c. locking means mounted in said plate and including a locking element having a locking end and mounted for reciprocal movement, and said plate being rotatable to bring said element into alignment with selected ones of said recesses, said locking end shaped to make locking engagement within said recesses, whereby said locking element is releasably engagable in a selected recess to hold said plate stationarily against rotation relative to said disk.

2. An assembly as defined in claim 1 including means for resiliently biasing said locking element towards engagement with said disk.

3. An assembly as defined in claim 1 including a flat support sheet adapted for attachment to said snowboard upper surface whereby the bottom of said plate is supported in slidable engagement with said support sheet.

4. An assembly as defined in claim 1 wherein said plate opening edge portion includes a generally upwardly-facing annular surface, and said disk has an annular surface for slidably engaging said plate annular surface to hold said plate against relative upward movement.

5. An assembly as defined in claim 4 wherein said disk edge means includes a cylindrical surface that is journaled within said plate opening edge portion.

6. An assembly as defined in claim 1 wherein said locking element is mounted for slidable axial movement in a bore extending from said plate perimeter edge to said plate opening edge portion.

7. An assembly as defined in claim 3 wherein said support sheet has a top layer of a low-friction material.

8. An assembly as defined in claim 6 wherein the bore for said locking element extends inwardly from a front corner portion of said plate perimeter edge.

9. An assembly as defined in claim 6 wherein said bore extends radially with respect to said plate opening.

10. An assembly as defined in claim 1 wherein said locking element has an inner end, and an outer end disposed to the exterior of said plate and adapted to be grasped by hand.

11. An assembly as defined in claim 10 including a tensioned elastic member interconnecting said locking element outer end and said plate, for urging said element towards said disk.

12. An assembly as defined in claim 2 wherein said resilient biasing means includes spring means mounted within said plate.

13. An assembly as defined in claim 1 wherein there is an array of multiple regularly spaced recesses along said disk edge means, and said locking end has a plurality of projections for engaging a selected plurality of said recesses.

14. An assembly as defined in claim 1 including means for releasably locking said locking element in a disk recess-engaging position.

15. An assembly as defined in claim 1 wherein said locking end and said recesses are shaped such that when said locking end makes locking engagement within said recess and rotational forces are exerted between said bindings plate and said disk, said locking end is not subjected to camming forces tending to disengage said locking end from said recess.

16. An assembly as defined in claim 13 wherein said array of recesses is provided by multiple spaced-apart first splines and said locking end projections comprise a plurality of second splines.

17. An assembly as defined in claim 16 wherein said first splines comprise gear teeth.

18. An assembly as defined in claim 1 wherein said recesses comprise radially extending bores and said locking tip is adapted to be received within said bores.

19. An assembly as defined in claim 15 wherein there is an array of multiple regularly spaced recesses along said disk edge means, and said locking end has a plurality of projections for engaging a selected plurality of said recesses.

* * * * *

UNITED STATES PATENT AND TRADEMARK OFFICE

CERTIFICATE OF CORRECTION

PATENT NO : 5,826,910

DATED : 10/27/98

INVENTOR(S) : Richard A. Ricks and Paul R. Scherer

It is certified that error appears in the above-identified patent and that said Letters Patent are hereby corrected as shown below:

In claim 1, line 5,

"rotatable bindings having a bottom" should read:

--rotatable bindings plate having a bottom--.

Signed and Sealed this

Third Day of October, 2000

*Attest:*

Q. TODD DICKINSON

*Attesting Officer*

*Director of Patents and Trademarks*